US006312074B1

(12) United States Patent
Walker

(10) Patent No.: US 6,312,074 B1
(45) Date of Patent: Nov. 6, 2001

(54) METHOD AND APPARATUS FOR DETECTING FLUID LEVEL IN A FLUID CONTAINER

(75) Inventor: Ray A. Walker, Eugene, OR (US)

(73) Assignee: Hewlett-Packard Company, Palo Alto, CA (US)

( * ) Notice: Subject to any disclaimer, the term of this patent is extended or adjusted under 35 U.S.C. 154(b) by 0 days.

(21) Appl. No.: 09/303,248

(22) Filed: Apr. 30, 1999

(51) Int. Cl.[7] ..... B41J 2/195
(52) U.S. Cl. ..... 347/7
(58) Field of Search ..... 347/7; 73/290 V

(56) References Cited

U.S. PATENT DOCUMENTS 3,814,146 * 6/1974 Mesh ..... 73/290 V
5,054,318 * 10/1991 Lew ..... 73/290 V
5,079,570 1/1992 Mohr et al. ..... 347/7
5,689,288 * 11/1997 Wimmer et al. ..... 347/7
5,812,156 9/1998 Bullock et al. ..... 347/19

* cited by examiner

*Primary Examiner*—John Barlow
*Assistant Examiner*—Michael S. Brooke
(74) *Attorney, Agent, or Firm*—Kevin B. Sullivan; Teri G. Andrews

(57) ABSTRACT

The present invention is a fluid level sensing system for determining fluid levels in a fluid container. The system has a resonant member with an attached magnet. The resonant member is disposed in the fluid container. The system also has a sensing device for sensing motion of the magnet. The movement of the magnet attached to the resonant member is indicative of fluid level in the fluid container.

6 Claims, 5 Drawing Sheets

501
503

505
507

509
511

509
511

METHOD AND APPARATUS FOR DETECTING FLUID LEVEL IN A FLUID CONTAINER

FIELD OF THE INVENTION

This invention relates to inkjet printers and, more particularly, to an inkjet printing system that makes use of sensing to determine ink level in the ink supply.

BACKGROUND OF THE INVENTION

Inkjet printers include a drop ejection device and a supply of printing fluid such as ink for replenishing ink to the drop ejection device. In the case of thermal inkjet printing, the drop ejection device is typically referred to as a printhead. Printing is accomplished by the selective actuation of the printhead as the printhead is moved relative to a print media. One common type of previously used inkjet printer uses a replaceable print cartridge that contains a printhead and a supply of ink contained within the print cartridge. This type of print cartridge is not intended to be refillable. When the initial supply of ink is depleted, the print cartridge is disposed of, and a new print cartridge is installed.

Another type of inkjet printer makes use of an ink reservoir that is separately replaceable from the printhead. The replaceable reservoir can be positioned on a scanning carriage with the printhead or positioned off the scanning carriage. In the case where the ink cartridge is mounted off carriage, the ink cartridge is either continuously in fluid communication with the printhead such as being connected by a flexible conduit or intermittently connected by positioning the carriage at a refilling station. The use of a replaceable ink container allows for the replacement of the ink container separately from the printhead, allowing the printhead to be used until end of printhead life, reducing the cost per page of printing.

Regardless of the inkjet printer configuration, it is important that the system have an accurate means of indicating when a low or out of ink condition has occurred to avoid exhausting one or more of the ink supplies in the middle of a printing job. In the case of large format printing, the job or sheet must be scrapped and the job restarted resulting in waste. Moreover, it is important that the printing system stop printing when the ink container is nearly empty. Allowing the inkjet printhead to reach the state of complete ink exhaustion can result in operation of the thermal printhead without ink, which can result in catastrophic damage and failure of the printhead.

There are clear advantages to knowing when the ink container is out of ink as well as having the ability to detect ink levels at numerous positions on the ink container. For example, with large format printers, which use a considerable amount of ink for covering large printing surfaces, the ability to compare ink requirements with the amount of ink remaining in the ink container prior to printing would be invaluable. In addition, providing more comprehensive feedback to the user of ink use allows the user to better anticipate when the ink containers will require replacement.

SUMMARY OF THE INVENTION

The present invention is a fluid level sensing system for determining fluid levels in a fluid container. The system has a resonant member with an attached magnet. The resonant member is disposed in the fluid container. Included is a sensing device for sensing motion of the magnet. The movement of the magnet attached to the resonant member is indicative of fluid level in the fluid container.

In one embodiment of the invention the sensing system includes an exciter driver and a signal receiving device. In this embodiment, the exciter driver invokes the resonant member to resonate and the signal receiving device senses movement of the attached magnet. The resonating signal has an amplitude that is damped according to a level of the fluid remaining in the fluid container. This amplitude is indicative of the fluid level of fluid container.

In yet another embodiment, there is a plurality of fluid containers with each of the fluid containers having a resonant member and a magnet. In this embodiment, the single signal exciter driver and the single signal receiving device are moved relative to the plurality of fluid containers so that the single signal exciter driver applies a resonating signal that selectively resonates each of the resonating members and is received by the single signal receiving device to selectively determine fluid level in each of the fluid containers.

DETAILED DESCRIPTION OF A PREFERRED EMBODIMENT

Figure 1:
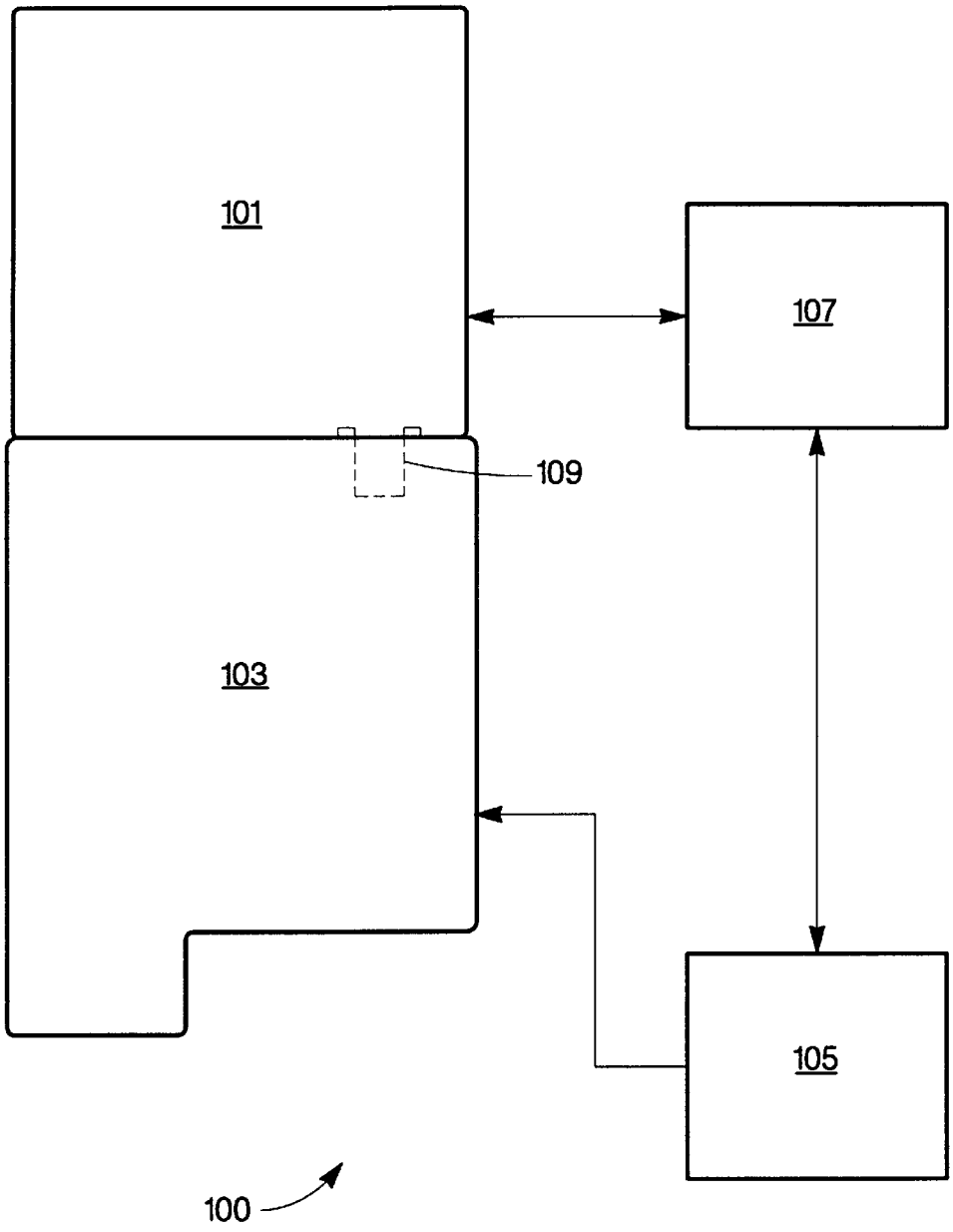
FIG. 1 depicts an inkjet printing system that includes an ink level sensing system for determining ink level in an ink container.

FIG. 1 depicts an inkjet printing system 100 that includes a printhead portion 103 for selectively depositing ink on print media (not shown) under the control of controller 105. Ink is provided to the printhead 103 by ink container 101. The ink container 101 includes a fluid outlet 109 for providing ink to the printhead 103 thereby replenishing the printhead 103 with ink. An ink level sense apparatus 107 determines ink level in the ink container 101 and provides ink level information to the controller 105.

The controller 105 is capable of preventing further operation of the printhead 103 once the ink container 101 is depleted of ink. In addition, the controller 105 provides ink level information to the customer so that a replacement ink container 101 is available to avoid interruption in printing.

In the case where the printhead 103 is a thermal inkjet printhead, it is critical that the printhead 103 be prevented from operation without an adequate supply of ink. Operation of the thermal inkjet printhead 103 without an adequate supply of ink can result in reliability problems as well as reduction in print quality. If operated for a sufficient period of time without an adequate supply of ink, the printhead 103 can incur catastrophic failure and permanent damage. It is critical that low ink or out-of-ink conditions of the ink container 101 is detected and that this information is provided to the controller 105 to prevent operation of the printhead 103 to ensure that permanent damage to the printhead 103 does not occur.

The ink level sense apparatus 107 of the present invention provides a reliable and cost efficient method for determining ink level information in the ink container 101, thus preventing damage to the printhead 103, as well as providing notification that the ink container 101 is in need of replacement.

Although the ink container 101 is shown as a replaceable ink container 101 that mounts directly to the printhead 103, other configurations can also be used in conjunction with the ink level sense apparatus 107 of the present invention. For example, the ink container 101 can be integrally formed with the printhead 103 in which case the entire assembly is replaced when the ink is depleted. For this example, the ink level sense apparatus 107 is used to determine ink level information in the entire assembly. In another example, the ink container 101 is mounted separate from the scanning carriage. Fluid conduits are provided for fluidically connecting the printhead 103 mounted in the scanning carriage with the ink container 101. In this configuration, ink level sense apparatus 107 monitors ink level information in the ink container 101 in this off-carriage location. If desired, an additional ink level sense apparatus 107 can be used to monitor ink 203 levels in the printhead portion 103.

Figure 2:
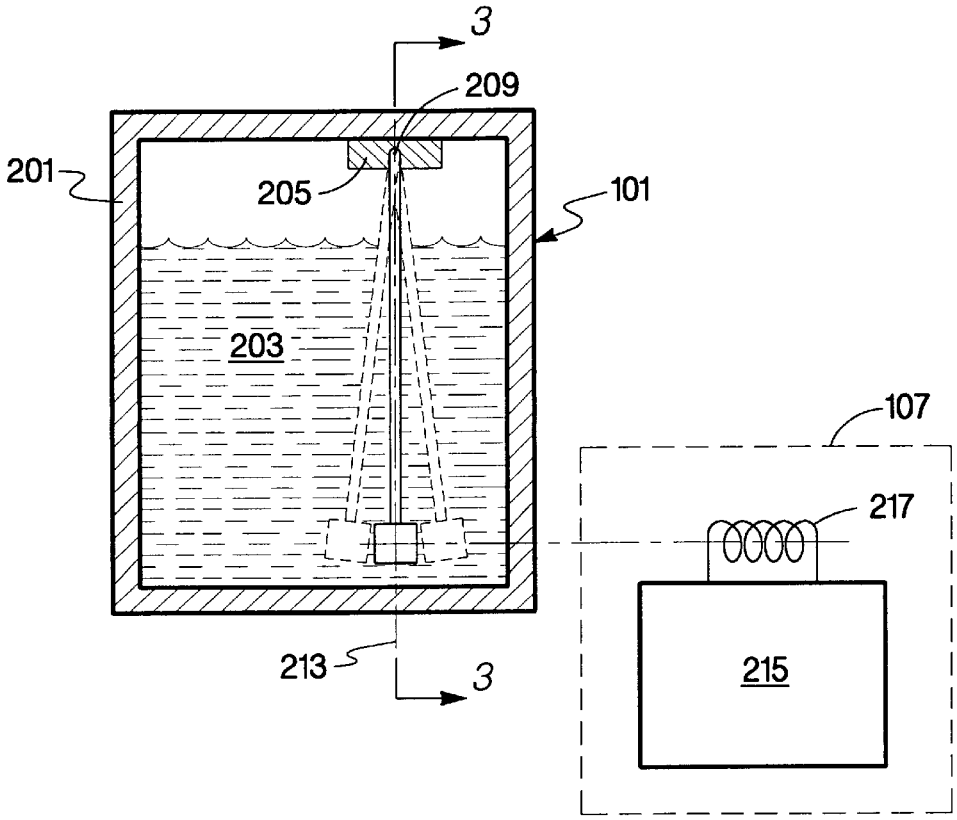
FIG. 2 depicts a preferred embodiment of the ink level sensing system of the present invention with the ink container shown partially filled with ink.

FIG. 2 depicts a preferred embodiment of the ink level sensing system of the present invention with the ink container 101 shown partially filled with ink 203. Ink container 101 includes a housing 201 with a mounting bracket 205 affixed to an interior surface of housing 201. A fixed end 209 of the resonant member 207 is attached to the mounting bracket 205. Attached to the opposite end of resonant member 207 is a magnet 211. In one preferred embodiment, when resonant member 207 is in a static position 213, the magnet 211 does not touch the interior bottom surface of ink container 101, thereby leaving resonant member 207 free to deflect when a magnetic field is applied by ink level sense apparatus 107 to magnet 211. The resonant member 207 is formed from a resilient material, so that when deflected the resonant member 207 tends to spring back into the static position.

Ink level sense apparatus 107 includes a coil 217 and an exciter driver and sense electronics 215. In one preferred embodiment, exciter driver and sense electronics 215 apply a time varying voltage to the coil 217. The time varying voltage induces a time varying magnetic field in a region proximate magnet 211. This time varying magnetic field has a period that is selected to excite the resonant member 207 at a frequency that causes the resonant member 207 to resonate or deflect back and forth as illustrated by the phantom lines.

With the resonant member 207 resonating the driver and sense electronics remove the time varying voltage from the coil 217. The coil 217 is then used to sense damping characteristics of the resonant member 207. As the resonate member 207 resonates, energy is stored in the spring action of the resonant member 207; thus, when the time varying voltage is removed from the coil 217, the resonant member 207 continues to resonate back and forth. As the resonant member 207 moves inside ink container 101, magnet 211 attached to resonant member 207 causes a current to be induced in the coil 217. Exciter driver and sense electronics 215 sense the amplitude of the induced current which is related to the damping characteristics of the resonant member 207 moving through ink in the ink container 101.

As the level of ink 203 is decreased, the damping or fluidic resistance of ink 203 on the resonant member 207 during resonance will decrease, thereby allowing the resonant member 207 to resonate longer. Conversely, as the level of ink 203 is increased, the damping or fluidic resistance of ink 203 upon resonant member 207 is greater, reducing the duration the resonant member 207 resonates. The current induced in the coil 217 is directly related to the movement of the magnet 211 and therefore is indicative of the damping characteristics of the resonant member 207. Because the damping characteristics are related to the ink level in the ink container, the induced current in coil 217 is directly related to ink level.

Since the fields applied and the signals subsequently sensed with relation to magnet 211 have no optical sensitivity, the material selected for housing 201 can be any plastic material, with color and opaqueness being immaterial. Similarly, in the preferred embodiment, mounting bracket 205 and resonant member 207 are made of plastic, with resonant member 207 having a suitable spring constant to provide resonance. Alternatively, resonant member 207 could be formed from various other materials such as spring steel or other resilient materials. One preferred shape for magnet 211 is cylindrical. In one preferred embodiment, magnet 211 is attached to resonant member 207 and the combination of resonant member 207 and magnet 211 are enclosed in a thin skin of plastic that is impervious to ink.

System timing and control circuitry for the preferred embodiment of the present invention will be discussed in greater detail later in the specification by means of a component block diagram (FIG. 5) and a timing diagram (FIG. 6).

Figure 3:
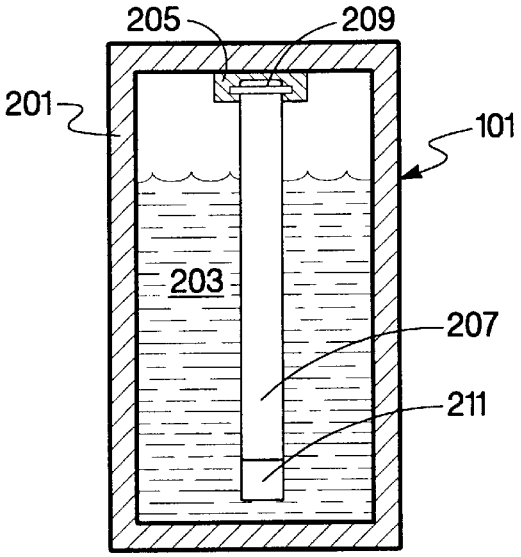
FIG. 3 is a cross-section of the resonant member of the present invention taken through line 3—3 of FIG. 2.

FIG. 3 is a cross-section through line 3—3 of FIG. 2 providing a side view of the resonant member 207 in the preferred embodiment of the present invention. In this preferred embodiment, resonant member 207 is shown to be wider than it is thick (thickness shown in FIG. 2) and relatively constant in width from connection at fixed end 209 to the base of magnet 211. This width will provide surface area for the ink 203 to apply resistance to resonant member 207, thereby damping the resonance of resonant member 207 more quickly when ink 203 is present. Quicker damping will provide for a more distinct signal to the printing system between ink present and out of ink conditions.

Alternatively, resonant member 207 is tapered with the widest portion at fixed end 209 to the narrowest portion, or free end, at magnet 211, creating a detectable, and thereby measurable, variation between the "full" and "empty" states of ink container 101. In this configuration, the system will work as a "gas gauge" so the user is always aware of the remaining amount of ink.

Figure 4:
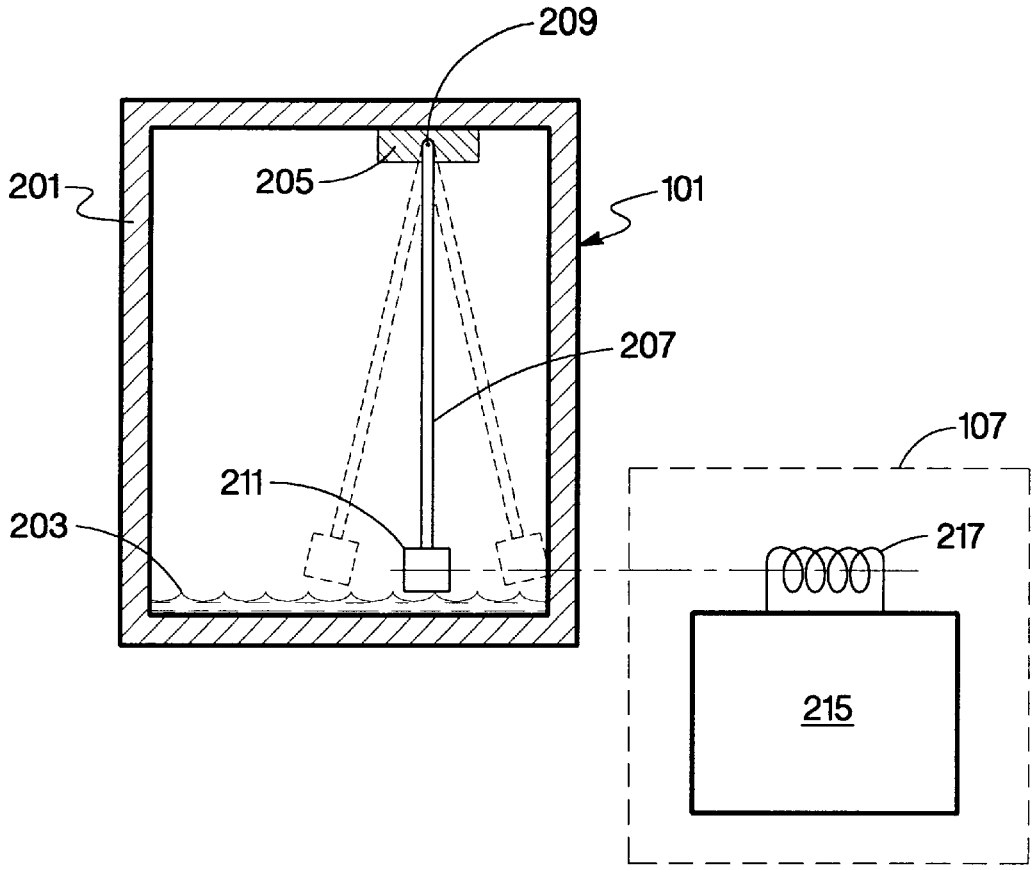
FIG. 4 depicts the ink level sensing system of FIG. 2 shown with the ink container substantially depleted of ink.

FIG. 4 depicts the ink level sensing system of FIG. 2 shown with the ink container 101 substantially depleted of ink 203. As previously discussed in FIG. 2, with the ink 203 in a near depleted state, resonant member 207 will experience a greater deflection in the absence of ink 203, as indicated by the phantom lines. When the time varying electromagnetic field generated by coil 217 is not present, resonant member 207 will "ring," or resonate freely for a longer period of time in the absence of the resistance of the ink 203 on resonant member 207. This resonance or damping characteristic of the resonant member 207 is sensed by currents induced in coil 217 that are sensed by the driver and sense electronics 215 to determine a low ink condition.

Figure 5:
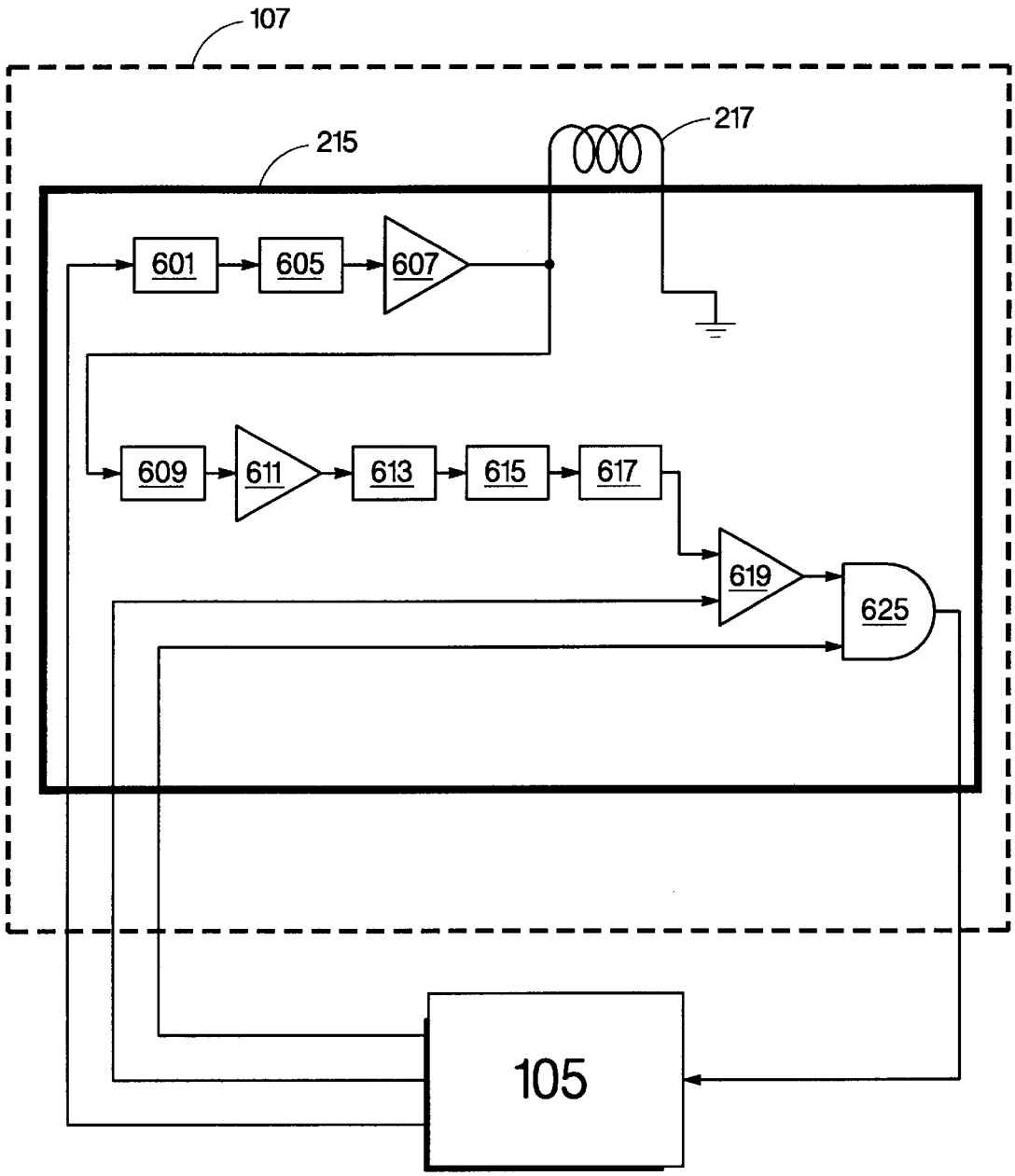
FIG. 5 depicts a block diagram of the ink level sensing system of the preferred embodiment of the present invention.

FIG. 5 depicts a block diagram of the printing system 100 that includes the ink level sensing apparatus 107 of the preferred embodiment of the present invention. The operation of the ink level sensing system 107 will be discussed with respect to the timing diagrams depicted in FIGS. 6A through 6H. The ink level sense apparatus 107 receives three input signals from the controller 105. These input signals include an exciter enable signal provided to the clock generator 601, a threshold level signal provided to the comparator 619 and a sense enable signal provided to AND gate 625. The ink level sense apparatus 107 provides an output signal that is indicative of ink level in the ink container 101 to the controller 105.

Figures 6A, 6B, 6C, 6D, 6E, 6F, 6G, 6H:
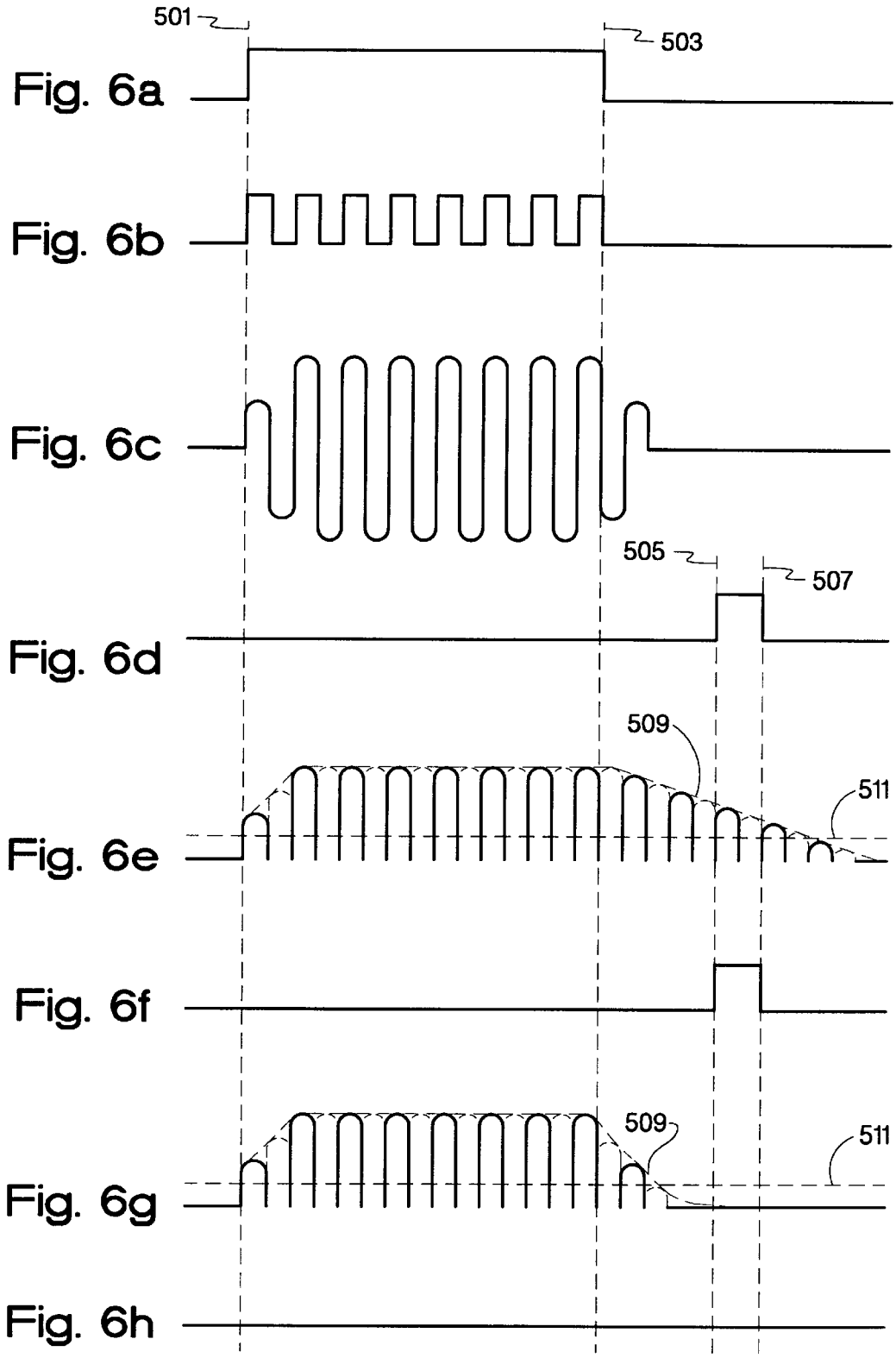
FIG. 6A through 6H depicts a timing diagram of the ink level sensing system of the preferred embodiment of the present invention.

In the block diagram of FIG. 5, the exciter enable signal, when active, initiates 501 a clock signal from the clock generator 601. The clock signal has a clock frequency that is selected to resonate the resonant member 207. The exciter enable signal is shown in FIG. 6A and the clock signal is shown in FIG. 6B.

The clock signal is provided to a first narrow band pass filter 605 that has a pass frequency selected to pass the clock frequency of the clock generator 601. The band pass filter 605 removes the high and low frequency components of the clock signal, resulting in a sinusoidal signal that is provided to the amplifier 607. The amplifier 607 amplifies the sinusoidal signal and provides the amplified sinusoidal signal to coil 217. The gain of the amplifier is determined by the strength of the magnetic field required to induce the resonant member 207 to resonate. This required field strength varies according to the size and placement of magnet 211 within ink container 101, as well as the placement of coil 217 relative to magnet 211.

Once the resonant member 207 is resonating, the exciter enable signal is inactivated 503, removing the drive voltage provided by the amplifier 607. The function of the coil 217 now changes from use as an "exciter" to use as a "sensor." The coil 217 is changed from use as an "exciter" to use as a "sensor" following the aforementioned excitation period. As previously discussed, magnet 211 attached to the resonant member 207 causes induced current in the coil 217 as the resonant member 207 resonates inside the ink container 101. This sense signal is both amplified and rectified by the exciter driver and sense electronics 215. After the excitation period ends, resonant member 207 will continue to resonate, gradually reducing it deflection over the next period of time. As discussed previously, if ink container 101 is "empty," the deflection "ring" continues for a longer period of time than when the ink container 101 is "full." This is because the presence of ink 203 dampens the ringing, while the absence of ink allows the resonant member 207 to more gradually reduce its deflection "ring" over a longer period of time.

The induced signal on the coil 217 is related to the motion of the resonant member 207. This induced signal on the coil 217, represented by FIG. 6C, is provided to a limiter 609. Limiter 609 is used to keep the sensor amplifier 611 out of saturation during the excitation period. Sensor amplifier 611 is ready for amplifying the induced current during the sense period shown in FIG. 6D without waiting for recovery from the overload or saturation that would otherwise occur. The output from the sense amplifier 611 is passed through a second narrow band pass filter 613 to reject noise signals outside the band of interest (i.e., the resonant frequency of the resonant member 207), and then is rectified by the rectifier 615 thereby producing a rectified sine wave as shown in FIG. 6E.

Sense enable input provided to AND gate 625 is activated after the excitation period as shown in FIG. 6D. The controller 105 which activates the sense enable input, does so for a period of time, hereinafter referred to as the sense period (represented by the spacing between reference numerals 505 and 507. The sense period is at a selected time when the resonant member 207 is either damped by the presence of ink to the point that resonant member 207 is in a static position, represented by the coil 217 voltage shown in FIG. 6G, or if ink 203 is not present, resonant member 207 is resonating as represented by the coil 217 voltage 509 shown in FIG. 6E.

Peak detector 617 determines the peak value of the sensed signal during the sense period. This peak value is provided to a comparator 619 that compares this peak value to the threshold value 511. If the peak value is less than the threshold value shown in FIG. 6G, the comparator 619 output is inactive. The comparator 619 inactive signal is indicative that the signal has been damped by the presence of ink 203. The comparator 619 inactive signal provided to the AND gate 625 will result in an inactive sense output signal as shown in FIG. 6H. A low sense output signal indicates "ink present" in the ink container 101.

Conversely, if the peak value is greater than the threshold value during the sense period as shown in FIG. 6G, it is inferred that the coil 217 voltage signal is created by the undamped resonant member 207, undamped because there is no ink 203 remaining in ink container 101 to create a damping effect on the resonation of resonant member 207. This condition creates an active signal on the output of comparator 619, which when combined with the sense enable input produces an active sense output signal at the AND gate 625 output, as shown in FIG. 6F, indicating the ink container 101 is low or out of ink.

Although the preferred embodiment senses an ink present condition or an out of ink condition, the system is made into a "gas gauge" type of detection system by adding additional comparators 619 each having a threshold input value indicative of the signal returned from a particular level if ink 203 remaining. For example, a full ink container 101 creates the greatest resistance, or damping effect, on resonant member 207; therefore, peak detector 617 output is a relatively low signal. With ink container 101 half-full, the damping is less; therefore, the peak detector 617 output is higher than the threshold input signal for a full ink container 101, but not as high as the value for an empty container. By determining the expected returning signal from resonant member 207 and magnet 211 for any level of remaining ink 203 in ink container 101, threshold input signal is set accordingly.

In an alternate embodiment, a sensing scheme senses the back voltage developed in coil 217 during the excitation period. One skilled in the art can appreciate that the methodology is fundamentally the same; however, the sense enable period occurs within the excitation period.

In yet another alternate embodiment, the resonant member 207 can be positioned in any location in the ink delivery system. In this manner the resonant member 207 can be used to detect the presence of ink in these locations for better monitoring the operation of the ink delivery system. For example, the resonant member 207 can be formed within the silicon printhead. The resonant member 207 is micromachined to form a mechanically resonant system within the printhead. This arrangement allows for a more accurate out of ink determination.

What is claimed is:

1. An ink level sensing system for determining ink levels in an ink container, comprising:

a resonant member disposed in the ink container and having a magnet member attached thereto; and a sensing device disposed adjacent to the ink container, the sensing device including a combination exciter driver/signal receiving mechanism, wherein the combination exciter driver/signal receiving mechanism both, acts on the magnet member of the resonant member to cause the resonant member to resonate and senses movement of the magnet member, wherein movement of the resonant member is indicative of ink level in the ink container.

2. The ink level sensing system of claim 1, wherein the resonant member further comprises a resonant member width that is constant from a first end to a second end of the resonant member, the resonant member width being perpendicular to the movement of the resonant member.

3. The ink level sensing system of claim 1, wherein the combination exciter driver/signal receiving mechanism receives a resonating signal, produced by the magnet member, having an amplitude, wherein the amplitude of the resonating signal is damped according to a level of the ink remaining in the ink container, the amplitude indicative of the ink level in the ink container.

4. The ink level sensing system of claim 1, wherein the ink container is a plurality of ink containers with each of the ink containers having the resonant member and the magnet member, wherein the combination exciter driver/signal receiving mechanism is moved relative to the plurality of ink containers so that the combination exciter driver/signal receiving mechanism both applies a resonating signal that selectively resonates each of the resonating members and is received by the combination exciter driver/signal receiving mechanism to selectively determine ink level in each of the plurality of ink containers.

5. An inkjet printing system, comprising:

an ink level detection device having a combination signal application/signal receiving portion;

a plurality of ink containers containing ink;

a plurality of inkjet printheads for selectively depositing ink on a print media, each of the plurality of inkjet printheads associated with an ink container of the plurality of ink containers, each ink container of the plurality of ink containers providing ink to a corresponding inkjet printhead of the plurality of inkjet printheads, with each ink container of the plurality of ink containers having a resonant member with a magnet attached thereon and fixed to an interior surface of the ink container; and means for moving the ink level detection device relative to the plurality of ink containers so that the combination signal application/signal receiving portion both, applies a signal to the magnet attached to the resonant member thereby invoking resonant movement of the resonant member and receives a resonating signal, produced by the magnet, having an amplitude from the resonant member thereby selectively determining the ink level within each of the plurality of ink containers by the amplitude of the resonating signal.

6. A method for detecting an ink level in an ink container, the method comprising:

providing the ink container, wherein a resonant member is fixed by a first end to an interior surface of the ink container and a magnet member is attached to a second end opposite the first end of the resonant member, the magnet member within detecting range of a combination signal application/signal receiving member;

initiating a resonation of the resonant member by applying a first signal generated by the combination signal application/signal receiving member to the magnet member; and reading a second signal, produced by the magnet member, with the combination signal application/signal receiving member, wherein the second signal determines an amplitude of the resonation, the amplitude indicative of the ink level in the ink container.

* * * * *